US010600530B2

(12) United States Patent
Kushima et al.

(10) Patent No.: US 10,600,530 B2
(45) **Date of Patent: *Mar. 24, 2020**

(54) CONDUCTIVE MEMBER

(71) Applicant: Sumitomo Wiring Systems, Ltd., Yokkaichi, Mie (JP)

(72) Inventors: Takao Kushima, Mie (JP); Hirokazu Nakai, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/249,531

(22) Filed: Jan. 16, 2019

(65) Prior Publication Data

US 2019/0148033 A1 May 16, 2019

Related U.S. Application Data

(63) Continuation of application No. 15/562,226, filed as application No. PCT/JP2016/062608 on Apr. 21, 2016, now Pat. No. 10,217,542.

(30) Foreign Application Priority Data

Apr. 21, 2015 (JP) ..... 2015-086441

(51) Int. Cl.
*H01B 5/12* (2006.01)
*H01R 4/02* (2006.01)
(Continued)

(52) U.S. Cl.
CPC ..... *H01B 5/12* (2013.01); *H01B 5/06* (2013.01); *H01R 4/023* (2013.01); *H01R 4/183* (2013.01);
(Continued)

(58) Field of Classification Search
CPC ... H01B 5/12; H01B 7/16; H01B 5/06; H01R 4/72; H01R 4/726; H01R 11/12; H01R 4/184; H01R 4/183; H01R 4/023
See application file for complete search history.

(56) References Cited

U.S. PATENT DOCUMENTS 2,211,615 A * 8/1940 Brickman ..... H01R 11/11 24/122.3
2,479,834 A * 8/1949 Herbert ..... H01B 7/04 337/192
(Continued)

FOREIGN PATENT DOCUMENTS

JP 2012130185 A 7/2012
JP 2014022142 A 2/2014
JP 2014082909 A 5/2014

OTHER PUBLICATIONS

International Search Report for Application No. PCT/JP2016/062608 dated May 31, 2016; 4 pages.

*Primary Examiner* — Briggitte R. Hammond
(74) *Attorney, Agent, or Firm* — Reising Ethington, P.C.

(57) ABSTRACT

A conductive member disclosed herein is a conductive member that is routed from the front to the rear of a vehicle, and includes: a shape-retaining tubular pipe member made of a metal having excellent conductivity; a braided wire having flexibility and configured to be crimped to be connected to a crimped connection portion provided at front and rear ends of the pipe member; a round terminal configured to be crimped and connected to the braided wire; and a heat-shrinkable tube that covers from a crimped portion of the round terminal at the front end to a crimped portion of the round terminal at the rear end.

13 Claims, 7 Drawing Sheets

(51) Int. Cl.

| | |
|---|---|
| ***H01R 4/18*** | (2006.01) |
| ***H01B 5/06*** | (2006.01) |
| ***H01R 4/72*** | (2006.01) |
| ***H01R 11/12*** | (2006.01) |

(52) U.S. Cl.
CPC ..... *H01R 4/184* (2013.01); *H01R 4/72* (2013.01); *H01R 11/12* (2013.01)

(56) References Cited

U.S. PATENT DOCUMENTS

| | | | | |
|---|---|---|---|---|
| 5,541,380 | A * | 7/1996 | Ogden | H01R 11/12 219/56 |
| 2012/0292101 | A1 | 11/2012 | Kato | |
| 2014/0284100 | A1* | 9/2014 | Ichikawa | B60R 16/0215 174/70 R |
| 2014/0284102 | A1* | 9/2014 | Ichikawa | B60R 16/0215 174/72 A |
| 2015/0222103 | A1 | 8/2015 | Inao | |

* cited by examiner

CONDUCTIVE MEMBER

CROSS REFERENCE TO RELATED APPLICATIONS

This application is a continuation of U.S. application Ser. No. 15/562,226, filed Sep. 27, 2017, and claims the benefit of Japanese Application No. JP2015-086441 filed on Apr. 21, 2015, the contents of both of which are hereby incorporated by reference in their entirety.

TECHNICAL FIELD

The technique disclosed herein relates to a conductive member.

BACKGROUND ART

A wire harness as described for example in JP 2012-130185A (referred to as "Patent Document 1") is known as a wire harness that connects devices and a battery installed in a vehicle. Terminals are provided respectively at opposite ends of the wire harness, and the terminals are connected to connection portions of the devices and a connection portion of the battery, respectively, and thereby, the devices are connected to each other by the wire harness.

When routing the wire harness, for example, underneath the floor of the vehicle, it is necessary to hold the wire harness along a routing path, while preventing the wire harness from drooping. Accordingly, the wire harness is routed along the routing path, while retaining the shape of the wire harness by inserting the wire harness through an exterior member such as a protector or a metal pipe. Such a technique, as described in JP 2014-82909A (Patent Document 2), is known.

SUMMARY

Meanwhile, routing the wire harness in the above-described manner requires the use of an exterior member or the like, so that the number of components associated with the routing of the wire harness increases and also the number of the man-hours increases, resulting in an increase of the manufacturing costs.

For this reason, a method is under consideration in which a tubular conductor having excellent conductivity such as a metal pipe is used as a conductive material, and a terminal end of the tubular conductor is directly connected to the connection portions of devices.

In the case of using the tubular conductor as a conductive material, the high shape retainability enables routing without using the exterior member, while retaining the shape. However, when the connection portion of a device is located behind another member, or the connection portion of a device is disposed in a narrow space, it is not possible to route the terminal end of the tubular conductor to the device.

The present specification discloses a technique that enables the conductive member to be connected to a device disposed, for example, at the back of another member or in a narrow space, while suppressing an increase in the manufacturing costs associated with the exterior member or the like.

The technique disclosed herein is directed to a conductive member to be routed in a vehicle, including: a shape-retaining tubular conductor having excellent conductivity; a flexible conductor that has flexibility and is connected to an end of this tubular member; and a terminal that is connected to the flexible conductor.

With this configuration, the routing for a portion of the vehicle that requires shape retention can be performed using the shape-retaining tubular conductor, and the routing for locations with a limited routing space, such as the vicinity of a device, can be performed using the flexible conductor. Accordingly, it is also possible to connect the conductive member to a device disposed at the back of another member or in a narrow space, without using an exterior member. Furthermore, the tubular member has a hollow shape, and thus can achieve a weight reduction of the conductive member as compared with a solid-core conductor.

The conductive member disclosed herein may have the following configuration.

The flexible conductor may be a braided wire.

With this configuration, it is possible to achieve a further weight reduction and to increase the degree of freedom in routing of the conductive member, as compared with a coated wire formed by coating a core wire made of a plurality of strands with an insulating coating.

A crimped connection portion that is crimped to the flexible conductor with the flexible conductor being inserted therein is provided at the end of the tubular member.

With this configuration, it is possible to easily connect the tubular member and the flexible conductor by simply inserting the flexible conductor in the crimped connection portion, and crimping the crimped connection portion such that the crimped connection portion is compressed from outside. This makes it possible to reduce the manufacturing costs as compared with cases where the flexible conductor is connected, by using a fastening member, to a tubular member provided with a fastening portion, and where the flexible conductor is welded to the tubular member.

An inner diameter dimension of the crimped connection portion may be set to be larger than an inner diameter dimension of other portions of the tubular conductor.

For example, when the outer diameter dimension of the flexible conductor is larger than the inner diameter dimension of the tubular member, it is conceivable to use a tubular member having a larger inner diameter in order to insert the flexible conductor into the crimped connection portion. However, the use of a tubular member having a larger inner diameter also increases the outer diameter dimension of the tubular member, thus resulting in an increase in the overall size of the conductive member. The use of a tubular member having a small thickness dimension to solve this problem may prevent an increase in the size of the conductive member, but reduces the cross-sectional area of the tubular member, making it impossible to ensure a cross-sectional area sufficient to accommodate the amount of current passing through the core wire in the tubular member.

However, with the above-described configuration, it is possible to connect the flexible conductor having a large diameter and the tubular member, while ensuring the cross-sectional areas of portions of the tubular conductor other than the crimped connection portion.

A collapsed portion formed by collapsing the tubular conductor may be provided at the end of the tubular conductor, and the flexible conductor may be welded to the collapsed portion.

The flexible conductor may be formed in a tubular shape, and a crimped connection portion to which a metal annular member externally fitted to the flexible conductor is crimped with the flexible conductor being placed thereon may be provided at the end of the tubular conductor.

The flexible conductor may be connected at opposite ends of the tubular conductor, and a region extending from a portion at one of the ends of the tubular conductor where the flexible conductor and the terminal are connected, to a portion at the other end of the tubular conductor where the flexible conductor and the terminal are connected may be covered by a tubular insulating waterproof covering.

With this configuration, a portion from one terminal to the other terminal is insulated and waterproofed by the waterproof covering. That is, the insulation between the two terminals can be ensured. Accordingly, when a plurality of conductive members are routed, it is possible to prevent the occurrence of a short circuit between the conductive members, and to prevent the occurrence of a failure caused by the entry of water into the connection portion between the flexible conductor and the terminal, and the connection portion between the flexible conductor and the tubular conductor.

The waterproof covering may be a tube that is shrunk by being heated.

With this configuration, the insertion of the tubular member into a tube before heating is performed on a large diameter tube before undergoing shrinking, and it is therefore possible to easily perform the insertion operation.

An end of the flexible conductor that is exposed from the terminal may be covered with a sealant so as to be integrated with the terminal, and an end of the waterproof covering may be intimately attached to the entire perimeter of an outer circumferential surface of the terminal.

With this configuration, an end of the flexible conductor that is exposed from the terminal is covered with a sealant so as to be integrated with the terminal, and an end of the waterproof covering is intimately attached to the entire perimeter of an outer circumferential surface of the terminal. Accordingly, it is possible to prevent the entry of water into the waterproof covering from the gap between the terminal and the waterproof covering or from the end of the flexible conductor.

With the technique disclosed herein, it is possible to connect a conductive member to a device disposed at the back of another member or in a narrow space, while suppressing an increase in the manufacturing costs associated with an exterior member or the like.

DESCRIPTION OF EMBODIMENTS

Embodiment 1

Embodiment 1 will be described with reference to FIGS. 1 to 4.

The present embodiment is directed at a signal-carrying conductive member 10 that connects a battery (not shown) disposed at the rear of a vehicle to devices (not shown) installed in an engine room provided at the front of the vehicle, and the routing path of the conductive member 10 between the battery and the engine room is underneath the floor of the vehicle.

Figure 1:
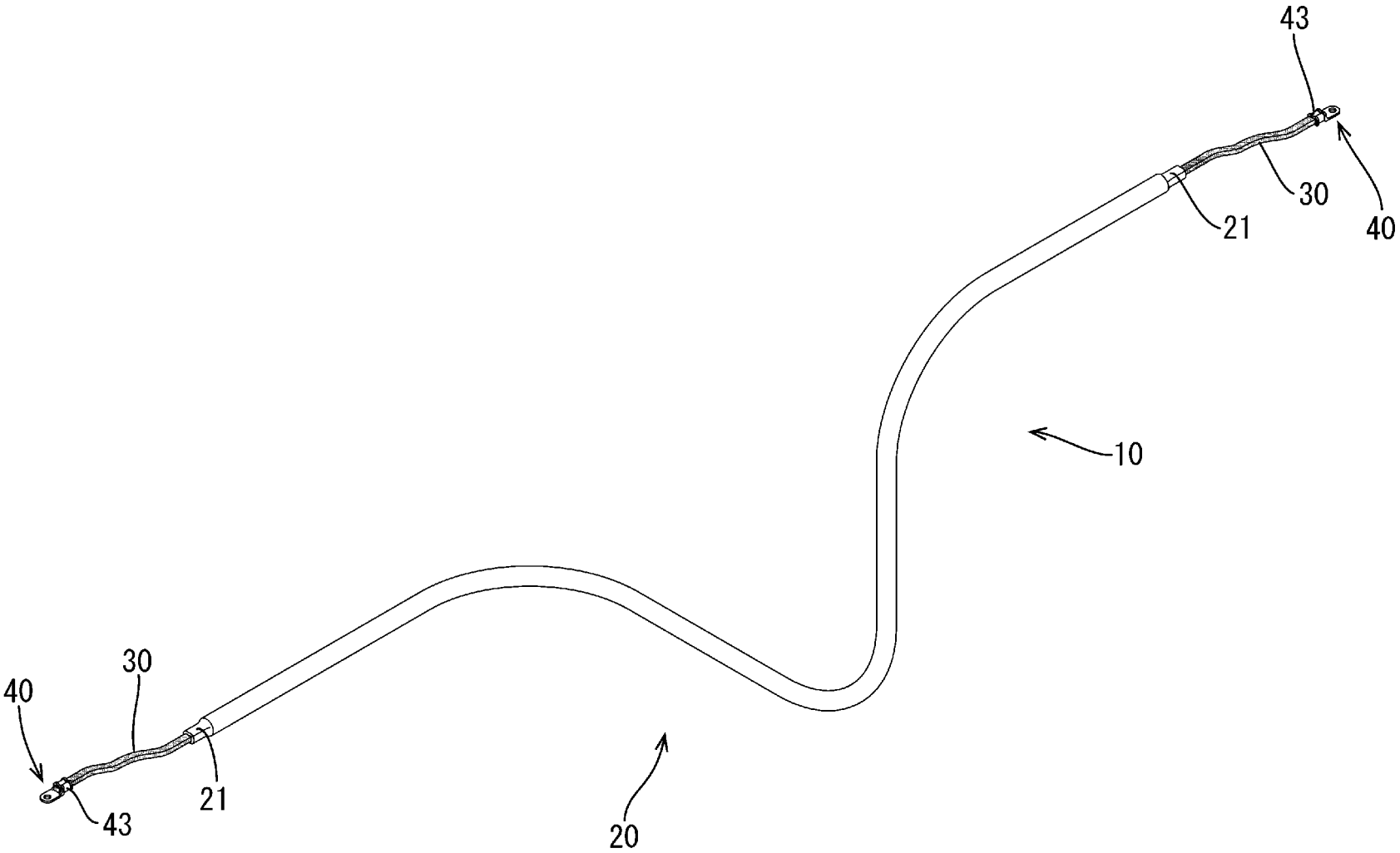
FIG. 1 is a perspective view of a conductive member according to Embodiment 1.
Figure 4:
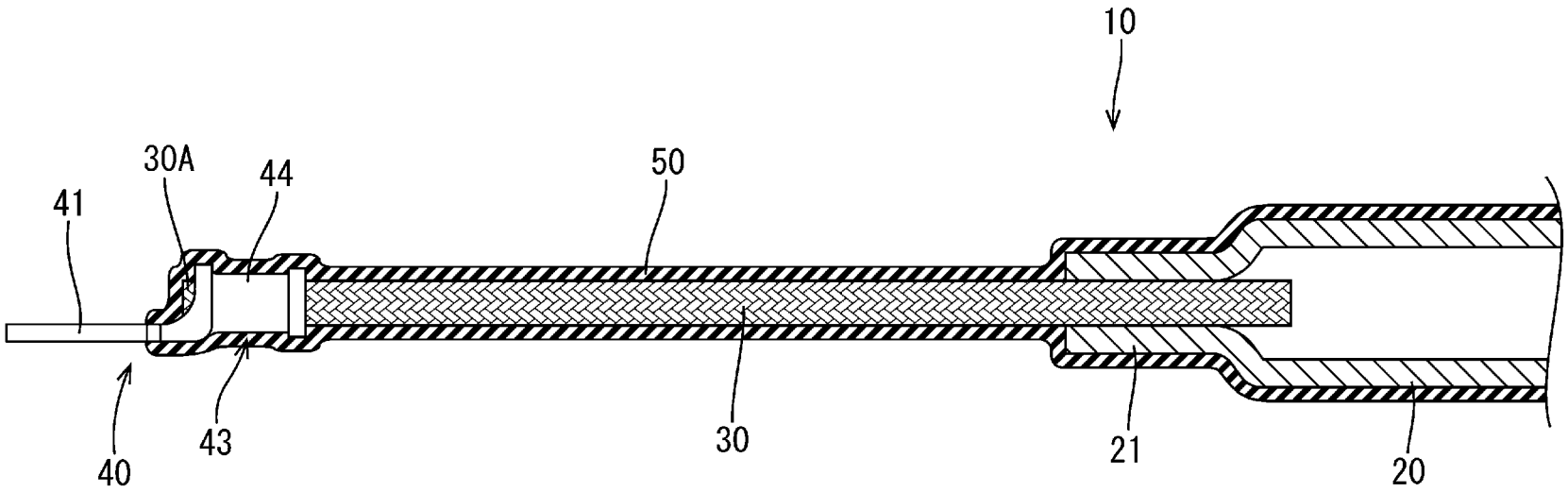
FIG. 4 is an enlarged cross-sectional view showing a principal part in a state where the round terminal, the braided wire, and the pipe member are covered by a shrinkable tube.

As shown in FIGS. 1 and 4, the conductive member 10 includes a pipe member (an example of a "tubular conductor") 20 extending in the front-rear direction from the engine room to the rear of the vehicle underneath the floor of the vehicle, flexible braided wires (an example of a "flexible conductor") 30 that are respectively connected to front and rear ends of the pipe member 20, round terminals (an example of a "terminal") 40 that are connected to the respective braided wires 30 on the side opposite to the side where the pipe member 20 is connected, and a tubular heat-shrinkable tube (an example of a "waterproof covering") 50 that covers the round terminals 40, the braided wires 30, and the pipe member 20. Note that the illustration of the heat-shrinkable tube 50 has been omitted in FIG. 1.

Figure 2:
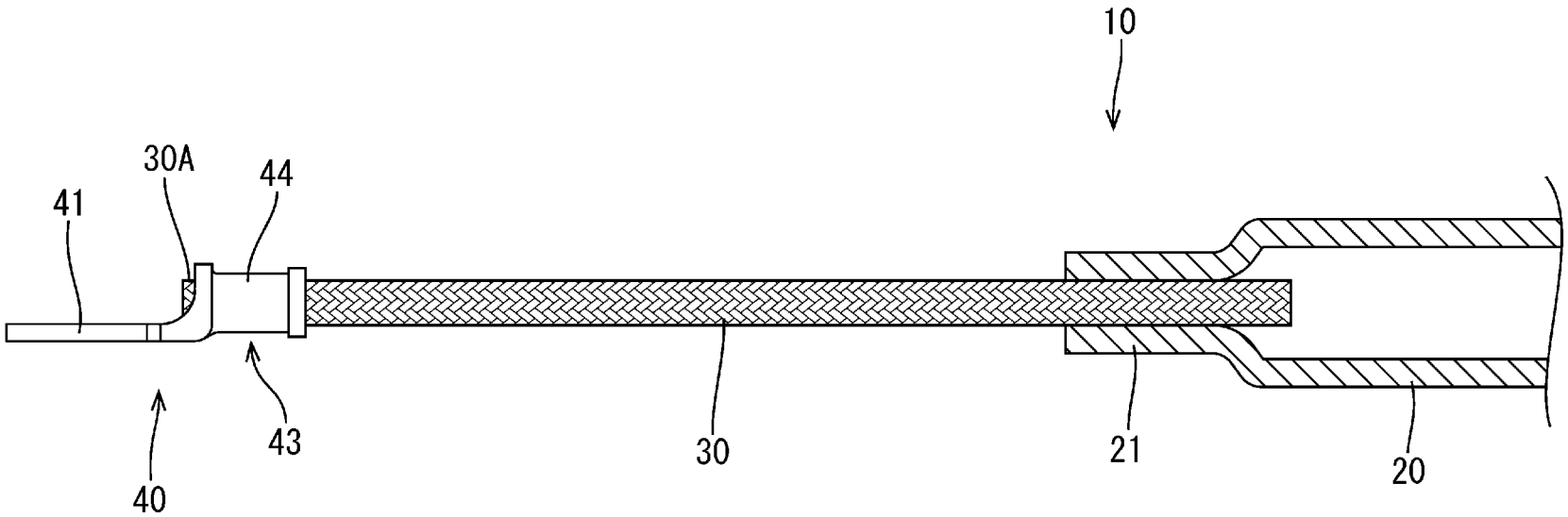
FIG. 2 is an enlarged cross-sectional view showing a principal part in a state where a round terminal, a braided wire, and a pipe member are connected.
Figure 3:
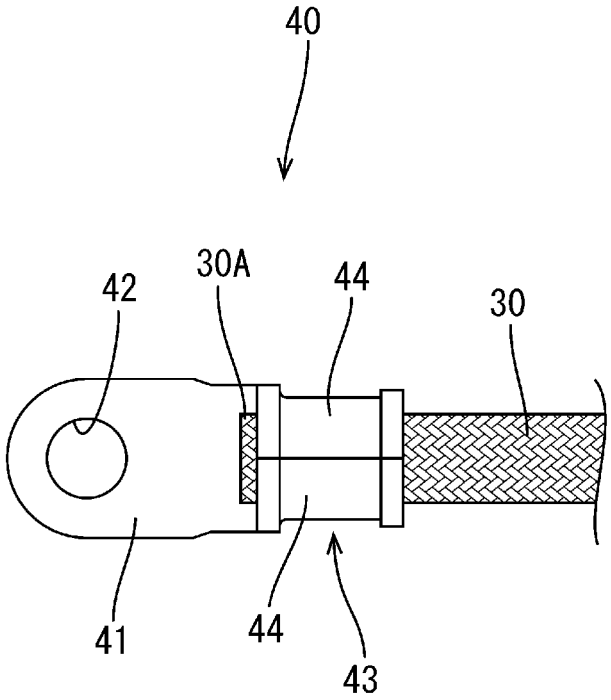
FIG. 3 is a plan view showing a state where the round terminal and the braided wire are connected.

As shown in FIGS. 2 to 4, each of the round terminals 40 is formed by shaping a metal plate material having excellent conductivity by stamping or the like, and includes a flat plate-shaped connection portion 41 having a round hole 42, and a crimped portion 43 formed integrally with the connection portion 41. The crimped portion 43 includes a pair of crimped pieces 44 that are crimped to the braided wire 30, which will be described later. The pair of crimped pieces 44 are crimped to an end 30A of the braided wire 30, thus wrapping in the respective ends of the braided wire 30.

As shown in FIGS. 1 to 4, each of the braided wires 30 is formed by braiding a plurality of fine, bare metal strands having excellent conductivity in a mesh pattern, and has the shape of a tube. As the metal strands, it is possible to use, for example, copper, a copper alloy, aluminum, or an aluminum alloy, and a copper alloy is used in the present embodiment. In the present embodiment, the surface of each metal strand is tin plated to form a tin-plated layer (not shown) thereon. The tin-plated layer inhibits the oxidation of the metal strand and the occurrence of rust thereon. However, a plated layer does not necessarily need to be formed on the surface of the metal strands.

The pipe member 20 is made of a metal having excellent conductivity, and has an interior having a hollow cylindrical shape as shown in FIGS. 1, 2, and 4. Here, as the metal having excellent conductivity for use as the pipe member 20, it is possible to use, for example, aluminum, an aluminum alloy, copper, or a copper alloy. In the present embodiment, an aluminum alloy is used. The pipe member 20 has a rigidity capable of retaining its shape, and is bent by bending so as to follow the routing path located underneath the floor of the vehicle. Note that the pipe member 20 is hollow, and thus can be more easily bent in the bending of the pipe member 20, than a solid-core member. The pipe member 20 also has an excellent in the geometrical moment of inertia, and thus cannot be easily deformed by bending and is capable of retaining its shape.

As shown in FIGS. 1, 2, and 4, crimped connection portions 21 that are crimped to be connected to the braided wires 30 are provided at opposite ends of the pipe member 20. The crimped connection portions 21 each have a substantially cylindrical shape before being crimped. To pressure-bond each of the crimped connection portions 21 to the corresponding braided wire 30, the end 30A of the braided wire 30 on the side opposite to the side where the round terminal 40 is connected is inserted inside the crimped connection portion 21, and the crimped connection portion 21 is crimped to the braided wire 30 such that the crimped connection portion 21 is compressed from opposite sides in the vertical direction.

That is, according to the present embodiment, the pipe member 20 and the braided wire 30 can be easily connected simply by placing the braided wire 30 inside the crimped connection portion 21, and crimping the crimped connection portion 21, compressing the crimped connection portion 21.

The heat-shrinkable tube 50 is an insulating tube that covers a region extending from the round terminal 40 at the front end to the round terminal 40 at the rear end. More specifically, the heat-shrinkable tube 50 covers the entire perimeter of the region extending from the crimped portion 43 of the round terminal 40 of the braided wire 30 connected to the crimped connection portion 21 at the front end of the pipe member 20 to the crimped portion 43 of the round terminal 40 of the braided wire 30 connected to the crimped connection portion 21 at the rear end of the pipe member 20, and the heat-shrinkable tube 50 is shrunk by being heated and intimately attached, without any gap, to the entire perimeters of the round terminals 40, the braided wires 30, and the pipe member 20.

That is, when the round terminals 40, the braided wires 30, and the pipe member 20 are covered by the heat-shrinkable tube 50, the region extending from the crimped portion 43 of the round terminal 40 disposed at the front end to the crimped portion 43 of the round terminal 40 disposed at the rear end is insulated and waterproofed.

The inner diameter of the heat-shrinkable tube 50 before being heat-shrunk is configured to be significantly larger than the outer diameter of the pipe member 20, so that an unbent pipe member 20 and even a bent pipe member 20 can be easily inserted into the heat-shrinkable tube 50. Accordingly, an unbent pipe member 20 may be inserted into the heat-shrinkable tube 50 before being heat-shrunk, and bending may be performed on the pipe member 20 after the heat-shrinkable tube 50 has been heat-shrunk. Alternatively, a bent pipe member 20 may be inserted into the heat-shrinkable tube 50 before being heat-shrunk, and thereafter, the heat-shrinkable tube 50 may be heat-shrunk.

Note that if edges of the crimped connection portions 21 of the pipe member 20 have a sharp shape due to shearing or the like of the pipe member 20, it is possible to prevent the edges of the crimped connection portions 21 from causing damage to the heat-shrinkable tube 50 by wrapping tape or the like around the edges after crimping the crimped connection portions 21 to the braided wires 30.

The configuration according to the present embodiment is as described above. Next, an example of the procedure for assembling the conductive member 10, as well as the function and effect of the conductive member 10 will be described.

First, the end 30A of the braided wire 30 is placed on the crimped portion 43 of the round terminal 40, and the pair of crimped pieces 44 are crimped to the end 30A of the braided wire 30, thereby connecting the round terminal 40 to one of the ends 30A of the braided wire 30.

Next, the braided wire 30 with the round terminal 40 is connected to the pipe member 20. Here, the pipe member 20 used may be in a state before being subjected to bending, or may be in a state after being subjected to bending.

As the first step to connect the braided wire 30 to the pipe member 20, the other end 30A of the braided wire 30 on the side opposite to the side where the round terminal 40 is connected is inserted in the crimped connection portion 21 of the pipe member 20.

After the end 30A of the braided wire 30 has been inserted in the crimped connection portion 21, the crimped connection portion 21 is crimped to be connected to the end 30A of the braided wire 30 such that the crimped connection portion 21 is compressed in the vertical direction. Consequently, the braided wire 30 with the round terminal 40 is connected to the end of the pipe member 20.

That is, according to the present embodiment, it is possible to easily connect the pipe member 20 and the braided wire 30 by simply crimping the crimped connection portion 21 of the pipe member 20 to the braided wire 30. Accordingly, it is possible to reduce the man-hours for the connection operation and the manufacturing costs as compared with cases, for example, where the pipe member and the braided wire are connected by connecting a fastening terminal to the braided wire, providing a fastening portion on the pipe member, and fastening the fastening terminal and the fastening portion together, or by welding the braided wire to the pipe member.

Then, the above-described step is performed also for the other end of the pipe member 20, and thereby, a pipe member 20 with the braided wires 30 with the round terminals 40 connected at the opposite ends can be formed.

Next, the pipe member 20 with the braided wires 30 connected thereto, which is formed by the above-described step, is inserted into an unshrunk heat-shrinkable tube 50, and the heat-shrinkable tube 50 is disposed so as to cover a region extending from a position slightly forward of the crimped portion 43 of the round terminal 40 at the front end to a position slightly rearward of the crimped portion 43 of the round terminal 40 at the rear end.

After the heat-shrinkable tube 50 has been disposed, the heat-shrinkable tube 50 is heat shrunk by subjecting it to a heat treatment. By this heat treatment, opposite ends of the heat-shrinkable tube 50 are intimately attached, with substantially no gap, to a portion of the round terminal 40 that is located between the round hole 42 of the connection portion 41 and the crimped portion 43, and an intermediate portion of the heat-shrinkable tube 50 is intimately attached to the outer circumferential surfaces of the braided wire 30 and the pipe member 20 without any gap. This completes a conductive member 10 in which a region extending from the crimped portion 43 of the round terminal 40 at the front end to the crimped portion 43 of the round terminal 40 at the rear end is insulated and waterproofed.

Then, the completed conductive member 10 is routed from the engine room of the vehicle via the underfloor portion of the vehicle to the rear of the vehicle.

Here, the pipe member 20 routed underneath the floor of the vehicle is bent into a predetermined shape in conformity with the routing path and the shape thereof is retained, thus making it possible to suppress an increase in the manufacturing costs associated with an exterior member and the like, while facilitating the routing operation.

According to the present embodiment, the pipe member 20 is formed in a hollow cylindrical shape, and it is therefore possible to retain its shape, while reducing its weight, as compared with the cases of a solid-core columnar conductive material and a plate-shaped conductive material. Furthermore, the pipe member 20 is also excellent in the geometrical moment of inertia, and thus is not easily deformed by being subjected to bending, and can retain its shape.

Since a plurality of devices are installed in the interior of the engine room in which the conductive member is routed, it is not possible to route the conductive member in a narrow space or to the devices located at the back of the engine room, for example, when the entirety of the conductive member has high shape retainability.

However, according to the present embodiment, the conductive member can be routed from the rear of the vehicle to the engine room by using the pipe member 20 having high shape retainability, and can be routed inside the engine room by using the braided wire 30 having flexibility. Accordingly, it is possible to route the conductive member in a narrow space, or connect the round terminal 40 to the connection portion of a device disposed at the back of the engine room.

That is, according to the present embodiment, routing can be performed by using different members for the portion that requires shape retention and the portion that requires flexibility, so that it is possible to easily perform routing of the conductive member 10 in the engine room, while suppressing an increase in the manufacturing costs resulting from the use of an exterior member or the like.

According to the present embodiment, the braided wire 30 having flexibility is provided at the opposite ends of the conductive member 10. Accordingly, even when vibrations resulting from the moving of the vehicle occur between the conductive member 10 and the devices, the braided wire 30 absorbs the vibrations, making it possible to prevent damage to the conductive member 10. In addition, the problem associated with the dimensional tolerance during connection to the devices can be solved by using the braided wire 30.

According to the present embodiment, the round terminal 40 and the pipe member 20 are connected by using the braided wire 30, and it is therefore possible to achieve a further weight reduction and a further increase in the degree of freedom in routing of the conductive member 10, as compared with a coated wire formed by covering a core wire with an insulating coating or the like.

Furthermore, according to the present embodiment, the region extending from the crimped portion 43 of the round terminal 40 at the front end to the crimped portion 43 of the round terminal 40 at the rear end is insulated and waterproofed by the heat-shrinkable tube 50. Accordingly, it is possible to prevent the corrosion of the conductive member 10, and the occurrence of a short circuit between adjacent conductive members 10.

Embodiment 2

Next, Embodiment 2 will be described with reference to FIG. 5.

A conductive member 110 according to Embodiment 2 is formed by changing the region covered by the heat-shrinkable tube 50 of Embodiment 1, and covering the end 30A of the braided wire 30 with solder (an example of a "sealant") 60. The description of the components, function, and effect that are common to Embodiment 1 is redundant and therefore has been omitted. In addition, components that are the same as those of Embodiment 1 are denoted by the same reference numerals.

Figure 5:
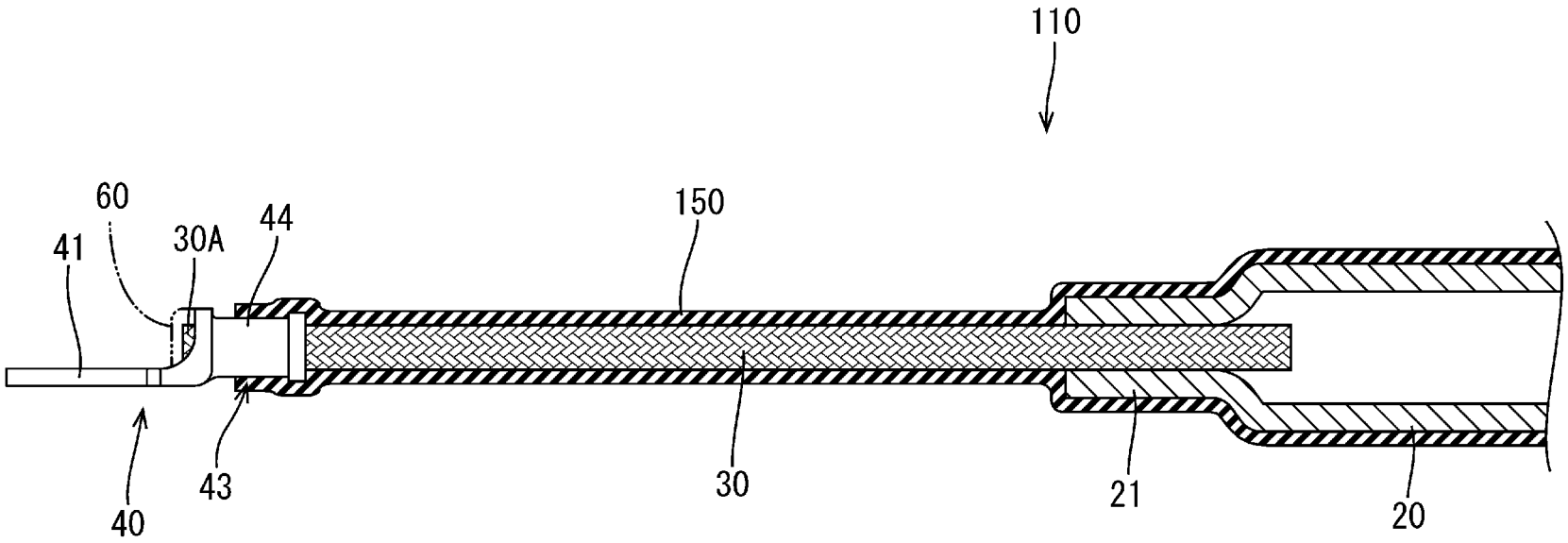
FIG. 5 is an enlarged cross-sectional view of a conductive member according to Embodiment 2, showing an enlarged cross-sectional view of a principal part in a state where an end of the braided wire is covered with a sealant, and the round terminal and the shrinkable tube are intimately attached to each other around the entire perimeter thereof.

As shown in FIG. 5, the heat-shrinkable tube 150 of Embodiment 2 has a configuration in which the crimped portion 43 of the round terminal 40 is covered, up to approximately the central portion in the front-rear direction. That is, the heat-shrinkable tube 150 covers the entire perimeter of the region extending from approximately the central portion in the front-rear direction of the crimped portion 43 of the round terminal 40 disposed at the front end to approximately the central portion in the front-rear direction of the crimped portion 43 of the round terminal 40 disposed at the rear end, and the ends 30A of the braided wires 30 that are exposed from the crimped portions 43 of the respective round terminals 40 toward the corresponding connection portions 41 are exposed from the heat-shrinkable tube 150.

On the other hand, as shown in FIG. 5, the end 30A of each of the braided wires 30 that is exposed from the crimped portion 43 toward the connection portion 41 is covered throughout its surface with solder 60, together with the end of the crimped portion 43 on the connection portion 41 side, and the gap between the end 30A of the braided wire 30 and the crimped portion 43 is sealed with the solder 60.

That is, according to the present embodiment, the region up to the crimped portion 43 of the round terminal 40 is waterproofed by the heat-shrinkable tube 150, and the end 30A of the braided wire 30 that is exposed from the crimped portion 43 toward the connection portion 41 is covered with the solder 60 to be integrated with the crimped portion 43 of the round terminal 40. Accordingly, it is possible to prevent the entry of water into the heat-shrinkable tube 150 from the gap between the braided wire 30 and the crimped portion 43 or from the end 30A of the braided wire 30.

Embodiment 3

Next, Embodiment 3 will be described with reference to FIG. 6.

A conductive member 210 according to Embodiment 3 is formed by changing the shape of the crimped connection portion 21 of Embodiment 1 and changing the braided wire 30 to a coated wire 230. The description of the components, function, and effect that are common to Embodiment 1 is redundant and therefore has been omitted. In addition, components that are the same as those of Embodiment 1 are denoted by the same reference numerals.

Figure 6:
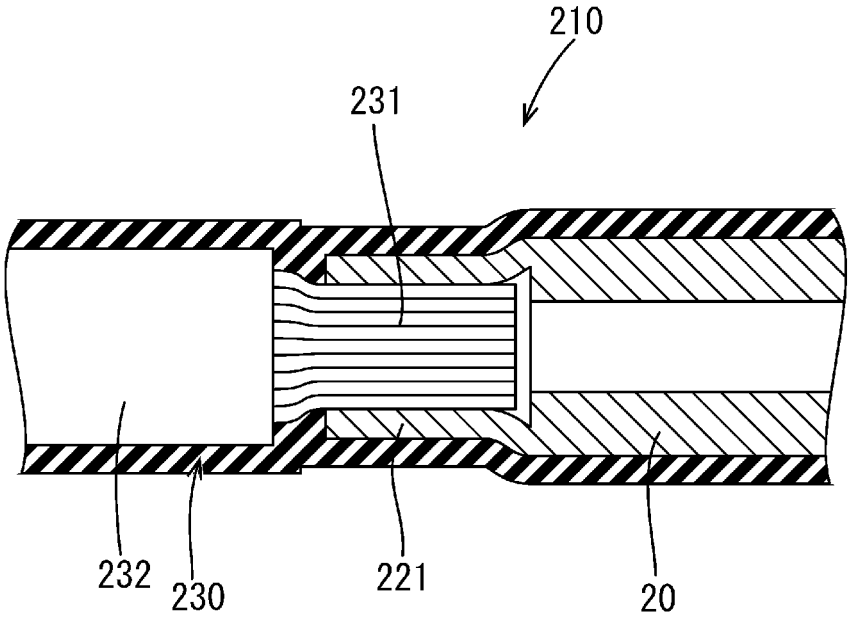
FIG. 6 is an enlarged cross-sectional view of a conductive member according to Embodiment 3, showing an enlarged cross-sectional view of a crimped connection portion.

As shown in FIG. 6, the coated wire 230 of Embodiment 3 is formed by covering a core wire 231 made of a plurality of bare metal strands having excellent conductivity with an insulating coating 232. At a terminal end of the coated wire 230, the insulating coating 232 is stripped off to expose the core wire 231, and the exposed core wire 231 is connected to the crimped portion 43 of the round terminal 40 and a crimped connection portion 231 of a pipe member 20, which will be described later. The cross-sectional area of the core wire 231 and the circular cross-sectional area of the pipe member 20 have substantially the same size, and a cross-sectional area sufficient to accommodate the amount of current passing between the two members 20 and 231 is ensured for each of them.

On the other hand, as shown in FIG. 6, the thickness dimension of the crimped connection portion 221 of the pipe member 20 of Embodiment 3 is set to be smaller than the thickness dimension of other portions of the pipe member 20. More specifically, in a state before the crimped connection portion 221 is crimped to the core wire 231, the outer diameter dimension of the crimped connection portion 221 is set to be the same outer diameter dimension as that of the other portions of the pipe member, and the inner diameter dimension of the crimped connection portion 221 is set to be larger than the inner diameter dimension of the other portions of the pipe member 20 by performing cutting or the like on the inner wall of the crimped connection portion 221. In other words, the thickness dimension of the crimped connection portion 221 is smaller than the thickness dimension of the other portions of the pipe member 20.

The inner diameter dimension of the crimped connection portion 221 is slightly larger than the outer diameter of the coated wire 230 before the core wire 231 is crimped, and is sized such that the core wire can be inserted in the crimped connection portion 221 without the strands of the core wire 231 sticking out from the crimped connection portion 221.

Then, the core wire 231 of the coated wire 230 is inserted in the crimped connection portion 221, and the crimped connection portion 221 is crimped around the entire perimeter from the outside, and thereby, the crimped connection portion 221 is fixed and electrically connected to the core wire as shown in FIG. 6.

Meanwhile, in the case of a pipe member in which the inner diameter of the crimped connection portion is the same as the inner diameter of the other portions of the pipe member, it is conceivable to use a pipe member having a large overall inner diameter in order to insert the core wire in the crimped connection portion. However, the use of a pipe member having a large inner diameter also increases the outer diameter dimension of the pipe member, thus resulting in an increase in the overall size of the conductive member.

The use of a pipe member having a small thickness dimension to solve this problem may prevent an increase in the size of the conductive member, but makes it impossible to ensure a cross-sectional area sufficient to accommodate the amount of current passing through the core wire in the pipe member.

However, according to the present embodiment, the inner wall of the crimped connection portion 221 is shaped so as to allow the core wire to be inserted in the crimped connection portion 221, and it is therefore possible to connect the crimped connection portion 221 and the core wire 231, while ensuring the cross-sectional area of the pipe member 20. Note that since the core wire 231 is inserted in the crimped connection portion 221 at the connection portion between the crimped connection portion 221 and the core wire 231, it is possible to ensure the cross-sectional area of the crimped connection portion 221.

Embodiment 4

Next, Embodiment 4 will be described with reference to FIG. 7.

A conductive member 310 according to Embodiment 4 is formed by changing the shape of the opposite ends of the pipe member 20 of Embodiment 1. The description of the components, function, and effect that are common to Embodiment 1 is redundant and therefore has been omitted. In addition, components that are the same as those of Embodiment 1 are denoted by the same reference numerals.

Figure 7:
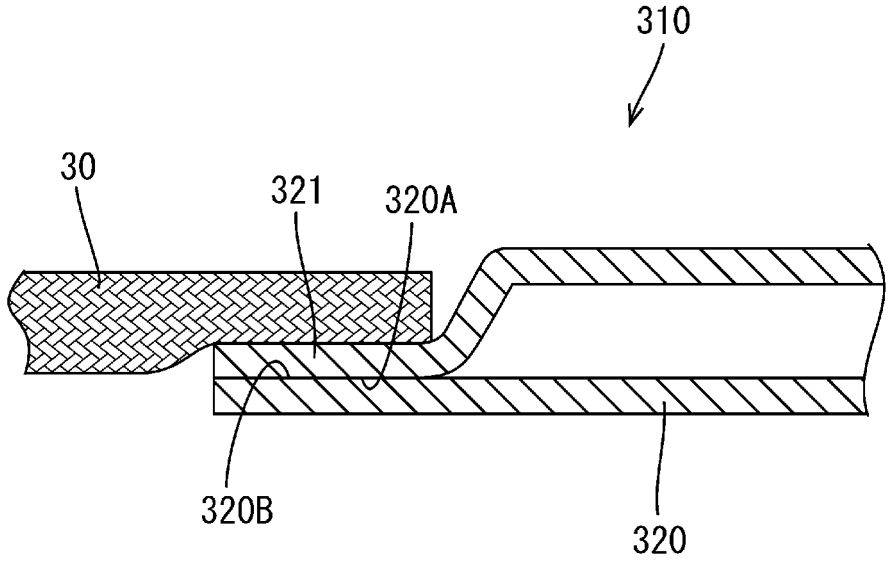
FIG. 7 is an enlarged cross-sectional view of a conductive member according to Embodiment 4, showing an enlarged cross-sectional view of a crimped connection portion.

As shown in FIG. 7, collapsed portions 321 to which the braided wires 30 are connected by welding are provided at opposite ends of the pipe member 320 of Embodiment 4. Each of the collapsed portions 321 is formed by compressing the pipe member 320 so as to bring an upper end-inner circumferential surface 320A of the pipe member 320 into contact with a lower end-inner circumferential surface 320B. Accordingly, the collapsed portion 321 has a configuration in which the opening of the pipe member 320 is closed and slightly wider than a middle portion (portion with a substantially cylindrical shape) of the pipe member 320.

Then, ultrasonic welding is performed on the collapsed portion 321 with the braided wire 30 placed on the collapsed portion 321, and thereby, the collapsed portion 321 and the braided wire 30 are electrically connected. Note that although the opening of the pipe member 320 is completely closed in the present embodiment, the opening of the pipe member 320 does not need to be completely closed.

Embodiment 5

Next, Embodiment 5 will be described with reference to FIG. 8.

A conductive member 410 according to Embodiment 5 is formed by changing the shape of the opposite ends of the pipe member 20 of Embodiment 1. The description of the components, function, and effect that are common to Embodiment 1 is redundant and therefore has been omitted. In addition, components that are the same as those of Embodiment 1 are denoted by the same reference numerals.

Figure 8:
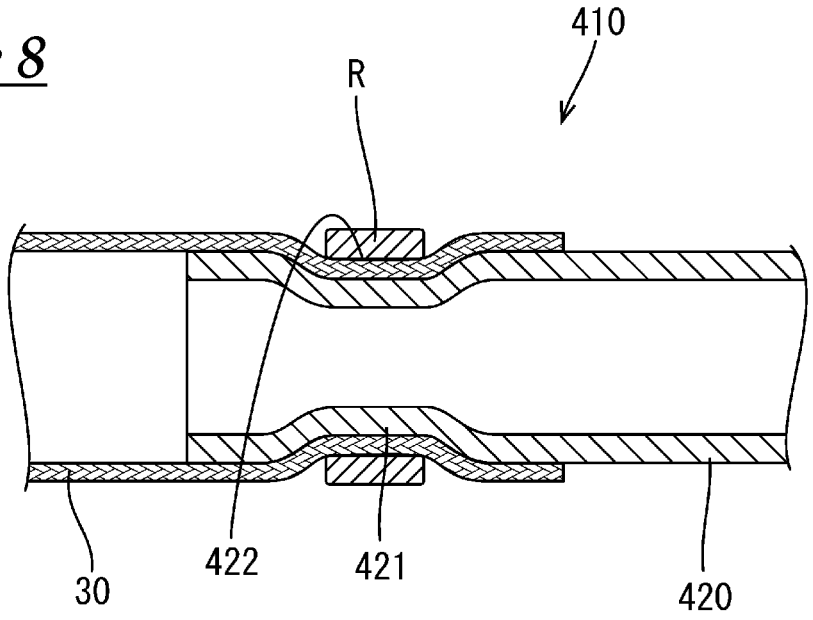
FIG. 8 is an enlarged cross-sectional view of a conductive member according to Embodiment 5, showing an enlarged cross-sectional view of a crimped connection portion.

As shown in FIG. 8, crimped connection portions 421 to which the braided wires 30 are crimped are provided at opposite ends of a pipe member 420 of Embodiment 5.

A metal crimping ring (annular member) R externally fitted to the outside of the braided wire 30 is crimped to the crimped connection portion 421 with the tubular braided wire 30 placed thereon, and the crimped connection portion 421 and the braided wire 30 are fixed and electrically connected to each other by the crimping ring R being crimped.

The outer circumferential surface of the crimped connection portion 421 is provided with a groove portion 422 formed by being recessed inward around the entire perimeter by being pressed inward during crimping of the crimping ring R, and the inner circumferential surface has a reduced inner diameter as a result of bulging inward.

That is, according to the present embodiment, the crimping ring R is fitted into the groove portion 422 of the outer circumferential surface of the crimped connection portion 421, and thereby, the crimping ring R is prevented from being displaced in the front-rear direction, thus ensuring the stability of connection between the crimped connection portion 421 and the braided wire 30.

Other Embodiments

The techniques disclosed herein are not limited to the embodiments described and illustrated above, and include, for example, various embodiment as follows.

In the above-described embodiments, the round terminal 40 and the braided wire 30 are crimped and connected, and the braided wire 30 and the pipe member 20 are crimped and connected. However, the disclosed technique is not limited thereto, and the members may also be connected by welding, brazing and soldering, or the like.

In the above-described embodiments, the braided wire 30 is used as the flexible conductor. However, the disclosed technique is not limited thereto. A coated wire may also be used as the flexible conductor, or a stripped wire, which is made of a core wire from which a coating has been stripped off, may be used.

In the above-described embodiments, the heat-shrinkable tube 50 is intimately attached to the outer circumferential surfaces of the round terminal 40, the braided wire 30, and the pipe member 20 by heat shrinking. However, the disclosed technique is not limited thereto. A bonding layer or an adhesion layer may be provided on the inner surface of a heat-shrinkable tube, and the heat-shrinkable tube may be intimately attached to each of these members through bonding and adhesion achieved as a result of the bonding layer or the adhesion layer being heated.

In the above-described embodiments, the conductive member is configured as a signal-carrying conductive member 10 that connects a battery to devices. However, the disclosed technique is not limited thereto, and the conductive member may be configured to as a high-voltage conductive member.

In the above-described embodiments, a round terminal 40 is used as the terminal. However, the disclosed technique is not limited thereto, and any terminal connectable to the braided wire, such as a male terminal or a female terminal, may be used as the terminal.

In Embodiment 2 described above, the solder 60 is used as a sealant for sealing the gap between the end 30A of the braided wire 30 and the crimped portion 43 of the round terminal 40. However, the disclosed technique is not limited thereto, and an adhesive or a brazing material other than solder may be used as the sealant.

In the above-described embodiments, the pipe member 20 is routed underneath the floor of a vehicle. However, the disclosed technique is not limited thereto, and the pipe member may be routed in any location of a vehicle where shape retention is required between devices.

In the above-described embodiments, a cylindrical pipe member 20 made of a metal and having excellent conductivity is used as the shape-retaining tubular member. However, the disclosed technique is not limited thereto. As the shape-retaining tubular member, a conductive resin may be formed in a tubular shape, or a member having a multilayer structure of a resin layer and a metal layer may be formed in a hollow tubular shape.

In Embodiment 5 described above, the groove portion 422 is formed on the crimped connection portion 421 during crimping of the crimping ring R. However, the disclosed technique is not limited thereto. A groove portion may also be formed in advance on the outer circumferential surface of the crimped connection portion, and the crimping ring may be crimped at the groove portion with the braided wire placed on the outer circumferential surface.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

10, 110, 210 Conductive member
20 Pipe member (tubular member)
30 Braided wire (flexible conductor)
40 Round terminal (terminal)
21, 221 Crimped connection portion
50, 150 Heat-shrinkable tube (waterproof covering)
60 Solder (sealant)
230 Coated wire (flexible conductor)

The invention claimed is:

1. A conductive member to be routed in a vehicle, comprising:

a tubular conductor having conductivity and opposite ends;

a first flexible conductor having first and second opposite ends, the first flexible conductor is more flexible than the tubular conductor, the first end of the first flexible conductor is electrically connected to the one end of the tubular conductor;

a first terminal that is connected to the second end of the first flexible conductor, a second flexible conductor having first and second opposite ends, the second flexible conductor is more flexible than the tubular conductor, the first end of the second flexible conductor is electrically connected to another end of the tubular conductor; and a second terminal that is connected to the second end of the second flexible conductor, wherein the first and second flexible conductors and first and second terminals are connected at the opposite ends of the tubular conductor, and a region extending from a portion at one of the ends of the tubular conductor where the first flexible conductor and the first terminal are connected, to a portion at the other end of the tubular conductor where the second flexible conductor and the second terminal are connected is covered by a tubular insulating waterproof covering.

2. The conductive member according to claim 1, wherein the waterproof covering is a tube that is shrunk by being heated.

3. The conductive member according to claim 1, wherein the second end of the first flexible conductor that is exposed from the first terminal is covered with a sealant so as to be integrated with the first terminal, and an end of the waterproof covering is intimately attached to an entire perimeter of an outer circumferential surface of the first terminal.

4. A conductive member to be routed in a vehicle, comprising:

a tubular conductor having conductivity and an end;

a flexible conductor having first and second opposite ends, the flexible conductor is more flexible than the tubular conductor, the first end of the flexible conductor is electrically connected to the end of the tubular conductor; and a terminal that is connected to the second end of the flexible conductor, wherein a crimped connection portion that is crimped to the first end of the flexible conductor with the flexible conductor being inserted therein is provided at the end of the tubular conductor, and an inner diameter dimension of the crimped connection portion is set to be larger than an inner diameter dimension of other portions of the tubular conductor.

5. A conductive member to be routed in a vehicle, comprising:

a tubular conductor having conductivity and an end;

a flexible conductor having first and second opposite ends, the flexible conductor is more flexible than the tubular conductor, the first end of the flexible conductor is electrically connected to the end of the tubular conductor; and a terminal that is connected to the second end of the flexible conductor, wherein the tubular conductor is longer than the flexible conductor.

6. The conductive member according to claim 5, wherein the tubular conductor is elongated.

7. A conductive member according to claim 5, wherein the tubular conductor has at least one bending point.

8. The conductive member according to claim 5, wherein the flexible conductor is a braided wire.

9. The conductive member according to claim 5, wherein a crimped connection portion that is crimped to the first end of the flexible conductor with the flexible conductor being inserted therein is provided at the end of the tubular conductor.

10. The conductive member according to claim 5, wherein a collapsed portion formed by collapsing the tubular conductor is provided at the end of the tubular conductor, and the flexible conductor is welded to the collapsed portion.

11. The conductive member according to claim 5, wherein the flexible conductor is formed in a tubular shape, and a crimped connection portion to which a metal annular member externally fitted to the flexible conductor is crimped with the flexible conductor being placed thereon is provided at the end of the tubular conductor.

12. The conductive member according to claim 5, wherein the flexible conductor is at least partially exposed from the terminal.

13. The conductive member according to claim 5, wherein the tubular member is not directly connected to the terminal.

* * * * *